United States Patent [19]

Hansen

[11] 4,434,512

[45] Mar. 6, 1984

[54] STAYLESS SHIRT COLLAR

[75] Inventor: Vagn A. Hansen, Prescott, Canada

[73] Assignee: Warnaco of Canada Limited, Prescott, Canada

[21] Appl. No.: 288,362

[22] Filed: Jul. 30, 1981

[30] Foreign Application Priority Data

Oct. 10, 1980 [CA] Canada ..... 362244

[51] Int. Cl.[3] ..... A41B 3/00

[52] U.S. Cl. ..... 2/129

[58] Field of Search ..... 2/129, 143, 255, 131, 2/132; 128/465

[56] References Cited

U.S. PATENT DOCUMENTS 3,088,117 5/1963 Baker ..... 2/129
4,228,547 10/1980 Peterson ..... 2/129

FOREIGN PATENT DOCUMENTS 332791 5/1933 Canada .
334089 7/1933 Canada .
366655 6/1937 Canada .
379216 1/1939 Canada .
394806 2/1941 Canada .
504552 7/1954 Canada .
517737 10/1955 Canada .
571771 3/1959 Canada .
650113 10/1962 Canada .
780089 3/1968 Canada .
969451 6/1975 Canada .

*Primary Examiner*—Doris L. Troutman
*Attorney, Agent, or Firm*—Wenderoth, Lind & Ponack

[57] ABSTRACT

A shirt collar is described which eliminates the need for stays, but yet lies flat and maintains a crisp and neat appearance with time. The disclosed collar includes a flexible lining material characterized in that it is relatively stiff in the transverse direction of the collar and relatively flexible in the longitudinal direction.

9 Claims, 4 Drawing Figures

STAYLESS SHIRT COLLAR

BACKGROUND OF THE INVENTION

The present invention is directed to shirt collars, and, more particularly shirt collars which do not require conventional stays.

Conventional woven lining used in the shirt industry today most often consists of cotton yarns of similar sizes in both warp and weft. Depending on the size and density of the yarns, the end product can be varied from light to heavy. No one lining by itself, however, has the properties needed to make the fold-over part of a collar (referred to hereinafter as the cape) rigid enough particularly in the area adjacent the knot of a tie, to appear crisp and neat, wash after wash. To this end, shirt manufacturers reinforce their capes with many varieties of stays (bones) which are inserted or attached by several different methods and which extend as far as possible into the points of the collar. Both home and commercial laundries have relied heavily on starch to put stiffness and body back into the collar after washing.

In the mid-seventies, a European process designed to combat the limp collar was accepted by the North American buying public. This involved laminating two pieces of cape lining into one, to result in a firmer cape, which was easier to iron after washing and much more attractive in appearance. The necessity for use of starch in the laundering of this type of shirt was eliminated. Still, manufacturers were unable to eliminate the need for a stay and those who attempted this failed, as the cape, in the area of the points, would curl progressively after laundering, usually out and up from the chest of the wearer.

The use of a stay has several drawbacks. When of the removable type they have a tendency to get lost. The permanent type, when subjected to abusive laundry and pressing conditions, may become brittle and disintegrate or tear away from the lining and float about in the cape. On almost any plain shade of shell cloth the shape of the stay will appear as a glossy image on the outside cape after commercial washing and pressing. For technical reasons it is virtually impossible to extend the stay to the extreme point of the cape. After some washings, as the finish in the lining gets worn, a marked difference will show in the point area. It will be rigid to the end of the stay, and limp from there to the end. The result is a "broken point" shaped like a drop of water about to fall from a tap.

In anything but top quality shirts, after a number of washings, the lining may become soft and collapse around the stay, making it appear as a hard elevated hump running bi-angular to the point.

SUMMARY OF THE INVENTION

It has been found that the foregoing disadvantages may be avoided by the use of a new type of stiffening material quite different from those previously known and used in the construction of shirt collars. By using this new type of stiffening material, stays may be entirely eliminated.

Accordingly, the present invention provides a stayless shirt collar cape having a base edge for attachment to a collar band, a finished free edge substantially parallel with said base edge, and two relatively short finished leading edges extending outwardly from the base edge to the free edge to form points. Such cape comprises exterior shells with an inter-lining disposed therebetween, and stiffening material disposed between the shells and secured to the interlining, the stiffening material being in the form of at least one patch extending from the points along the free edge in a longitudinal direction of the cape and along the leading edges in a transverse direction of the cape to coincide with a substantial area of the cape between the leading edges, the stiffening material being relatively stiff in the transverse direction of the cape and relatively flexible in the longitudinal direction of the cape. In a preferred embodiment, the stiffening material extends right to the leading edge so as to be virtually coincident therewith, but may be spaced slightly from the free edge. In a still further preferred form of the invention, two layers of the stiffening material occur along the leading edge.

The characteristics of this new stiffening material are that it is relatively stiff in the warp direction of the cloth, and relatively flexible in the weft direction. A particularly suitable material which has recently been introduced on the market is characterized in having warp threads of a heavy polyester monofilament cord and a weft thread of a lighter cotton yarn. This material is available from Spinnerei und Weberei, Gygli AG, 6301 Zug, Switzerland under their trade mark "Flexibone 6805", and Stotz & Co. Ltd., Walchester W. 15, CH-8023 Zurich, Switzerland under their trade mark "Telaflex". Suitable materials could also be prepared having weft threads consisting of man-made spun yarn as well. It will be appreciated that the composition of the stiffening material may vary depending upon the degree of stiffness required in one direction and the degree of flexibility required in the other direction.

Cape lining with this type of patch material laminated to it is characterized by having a very stiff but springy property in the warp direction and a pliable and soft property in the weft direction. A shirt collar having the required characteristics of flexibility in the longitudinal direction and stiffness in the transverse direction may thus be obtained by controlling the angle of cutting of the strips or patches used in construction of the cape from the stiffening material.

BRIEF DESCRIPTION OF THE DRAWINGS

In drawings which illustrate embodiments of the invention.

DETAILED DESCRIPTION OF THE PREFERRED EMBODIMENT

Figure 1:
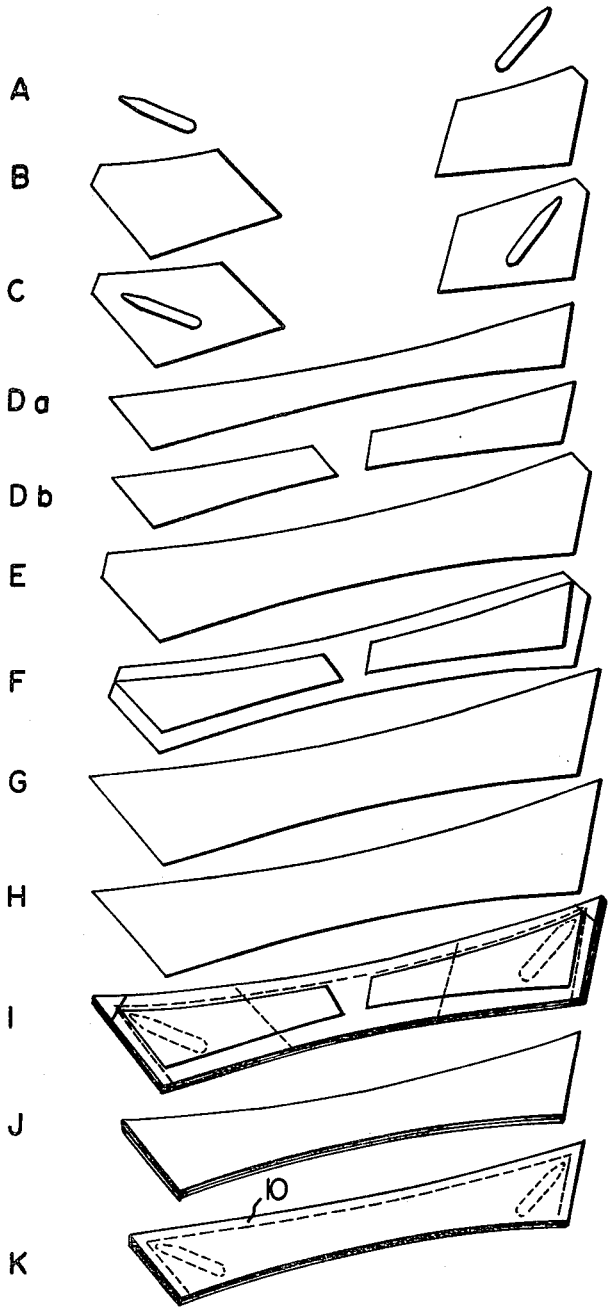
FIG. 1 PRIOR ART
FIG. 1 illustrates the components of a typical collar cape and the manner in which these components are assembled.
Figure 2:
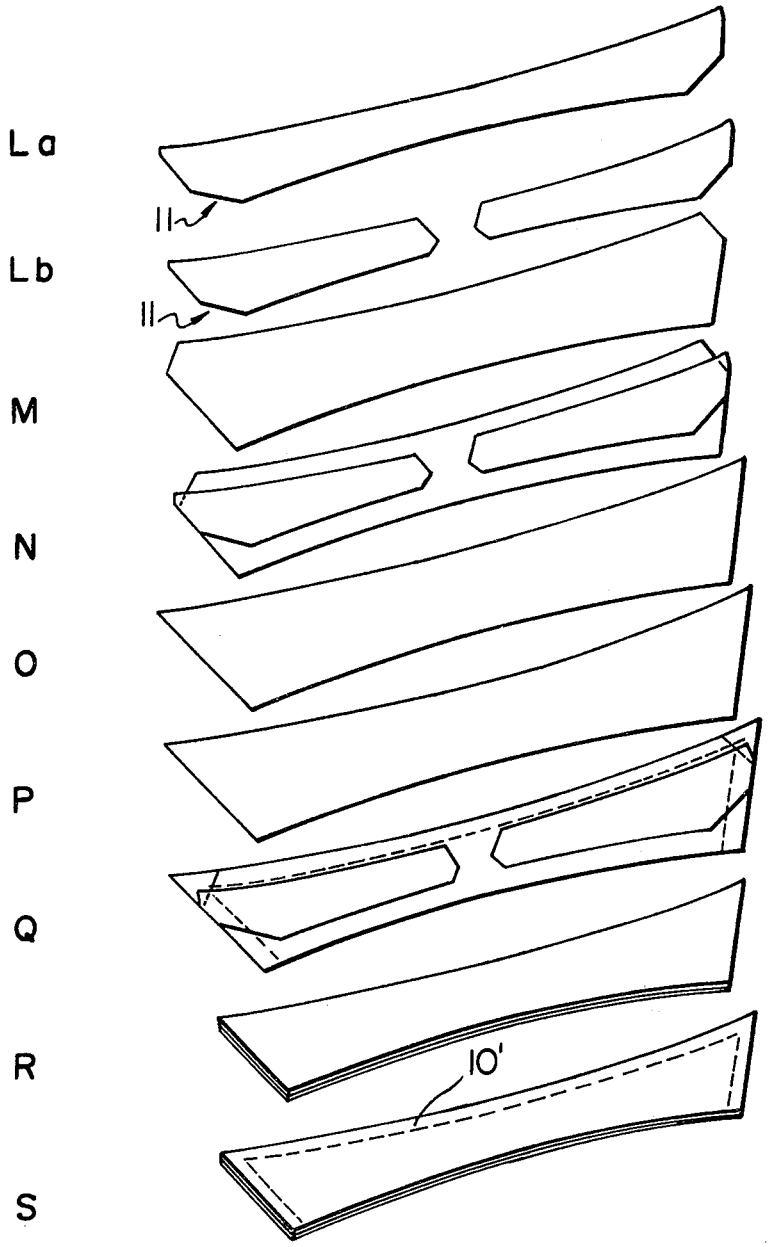
FIG. 2 illustrates the components of the stayless collar cape according to the invention and the manner in which the components are assembled.

Referring now to FIG. 1, a shirt cape can be constructed in a variety of ways and by varying the number of plies depending on the purpose for which it is intended. A good quality dress shirt cape is typically assembled of the following parts:

2 stays: FIG. 1A
2 stay pieces: FIG. 1B
1 fuse strip or 2 fuse patches: FIG. 1D*a* or 1D*b*
1 base lining: FIG. 1E

2 pieces of shell fabric: FIGS. 1G and H

Typically a cape is assembled as follows:

The stays 1A are attached to stay pieces 1B as illustrated at 1C.

Fuse strip 1D*a* or fuse patches 1D*b* are laminated to base lining or interlining 1E as illustrated at 1F. The component illustrated at 1F may now optionally be laminated to one of the shell fabric pieces 1G or 1H.

The entire set of components illustrated at 1C, 1F, 1G and 1H are now lined up on top of each other in a predetermined sequence and stitched along three sides, namely, the two leading edges and the free edge as illustrated in FIG. 1I, this latter being referred to as collar closing or collar running. No stitching is applied along the base edge of the collar, which will ultimately be connected to the neck band of a shirt. Typically, the collar components are layered in the following sequence, beginning at the bottom:

Stay pieces with attached stays 1C

Two pieces of shell fabric 1G and 1H

Base lining with laminated fuse patches 1F (or fuse strip, not illustrated).

The cape is now turned inside out to present a smooth one piece appearance as illustrated at 1J, hiding the closing seam and functional parts inside the exterior shells 1G and 1H which will form the finished outer surfaces of the cape of the collar.

Finally an outside seam referred to as topstitching (illustrated at 10 in FIG. 1*k* is applied along the leading edges and free edge, laying flat and securing the closing margin on the inside. In addition to providing a neat edge, seam 10 also prevents shifting, rolling or other displacement of any of the plies on the inside. Seam 10 also serves as a decorative feature of the finished collar cape.

The collar cape according to the invention is described with reference to FIG. 2. In many ways this cape is constructed in the same manner as the conventional type but of fewer plies, of different patch material, with the shape and position of the patch radically changed, and without any stays. The angle of cutting the patch from the patch material is also of importance. The cape is assembled of the following parts:

1 fuse strip or 2 fuse patches: FIG. 2L*a* or 2L*b*

1 base lining: FIG. 2M 2 pieces of shell fabric: FIGS. 2O and P

The fuse strip or fuse patches are cut from the stiffening material previously described and in a manner described in greater detail hereinbelow. The fuse patches (or fuse strip) are laminated to the base lining as illustrated at FIG. 2N. The component shown at 2N may now optionally be laminated to one of the pieces of shell fabric 2O or 2P.

The entire set of components shown at 2N, 2O and 2P are now lined up on top of each other in a pre-determined sequence and stitched along three sides in the collar closing or collar running step as illustrated at FIG. 2Q. Typically, the components are layered in the following order from the bottom upward:

Two pieces of shell fabric 2O and 2P

Base lining with laminated fuse patches 2N (or fuse strip, not illustrated).

The cape is now turned inside out to project a smooth one piece appearance hiding the closing seam on the inside as illustrated in FIG. 2R.

Finally an outside seam referred to as topstitching 10′ is applied as illustrated in FIG. 2S, laying flat and securing the closing margin on the inside. This seam 10′, again, results in a neat edge, and prevents shifting, rolling or other displacement of any of the plies on the inside between the external shells 2O and 2P. This seam also serves as a decorative feature of the finished collar cape.

The important differences between a conventional collar and the stayless collar according to the invention are as follows:

The stays, stay pieces and stay attachment step are eliminated.

Patch pieces or patches (FIGS. 2L*a* and 2L*b*) are cut from the new flexible lining material which is relatively stiff in the transverse direction of the collar, but is relatively soft and pliable in the longitudinal direction of the collar.

Figure 3:
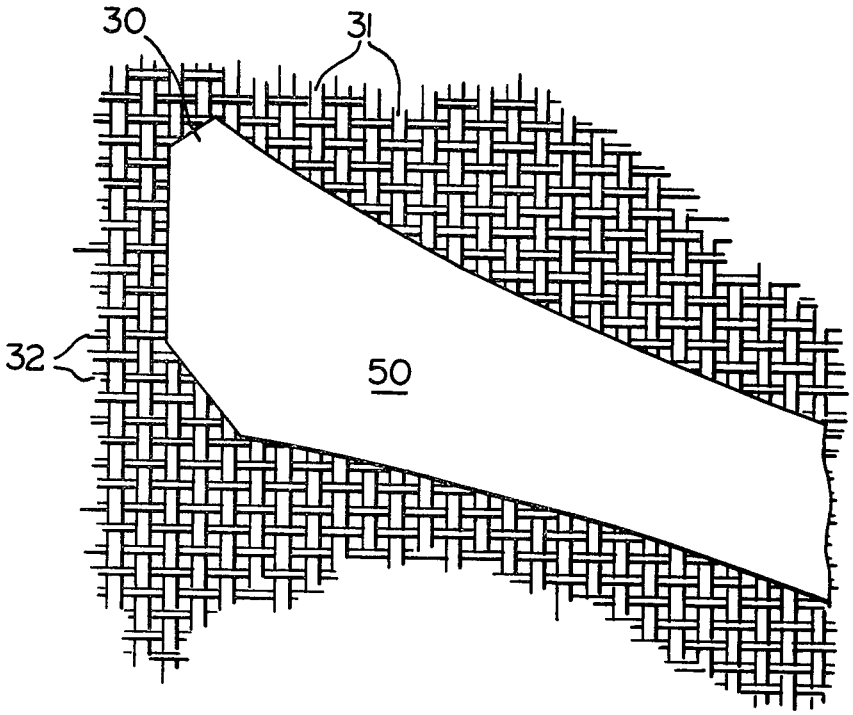
FIG. 3 illustrates the manner in which a patch die is positioned on the stiffening material before cutting.

As illustrated in FIG. 3, the patch cutting die 50 is so disposed with respect to the stiffening material that the leading edge 30 (point length) is parallel with the stiff warp threads 31 to avoid cutting these heavy polyester cords on the bias. The relatively soft and flexible weft threads 32 extend generally longitudinally with respect to the patch die 50. During stitching the needle will follow but deflect off the polyester cord and sew in the soft weft yarns when the edge runs parallel with the warp. If bias cut, the needle would penetrate and fragment the polyester cord leaving sharp edges that eventually could sever the sewing thread, lining and shell cloth rendering the garment useless after a few washings. For the same reason the use of a fuse strip would rarely be as suitable as a patch since an angled point always would leave at least one end of the strip bias cut. Only a completely square cape would facilitate cutting of such a strip in such a manner as to have both leading edges parallel to the warp threads.

Contrary to the traditional way of setting the patches or strip inside the closing seam in the end of the cape (FIG. 1F) the stayless collar will have these extended all the way to the edge of the base lining (FIGS. 2N or 2Q). When closed as illustrated at 2Q and turned as illustrated at 2R a double layer of the stiffening material cord is created in the extreme 10 mm or so of the leading edges of the cape, duplicating the strength and stiffness normally obtained by the insertion of a collar stay. Of course it is contemplated that two or more thicknesses of the stiffening material could be utilized in other areas of the collar cape, for example, by fusing smaller patches of the material to the main strip or patches.

This stiffness, however, may have a detrimental affect when a tie is to be worn. The cape instead of folding smoothly over the tie knot will have a tendency to "fly", making the points left away from the chest. To combat this, a cut-out in the strip or patch towards the base of the cape has been provided as illustrated at 11 in FIG. 2L*a* or L*b*. This will provide a void where the cape rests on top of the tie and, by reason of its shape when folded to double thickness as described above, gradually increase the stiffness of the collar cape along the leading edge, so that maximum stiffness is not reached until the tie knot has been cleared. The result is a smooth foldover affect around the tie knot. This cut-off shape also accomplishes an almost invisible transition from the thin to the heavy area of the leading edge compared to an obvious ridge that would have been created had a square cut-out been used.

The location of the patch in the point is also of importance. When the stitching margin, this being the portion of the unfinished collar cape outside the closing seam, is folded in by turning (FIG. 2R), the patch should at no point protrude beyond the stitching margin which runs along the length of the cape as the polyester cords could rub and damage the fabric. However, the distance between the patch and the stitching is kept to a minimum to ensure that the stiffening material extends to the very tip of the point. One of the important features of this cape is the stiff, even, no-bulk point which retains the same texture as the rest of the collar throughout the life of the garment, sharply contrasting with the conventional collar which, with wear, develops a definite "break" in the point where the collar stay ends.

Figure 4:
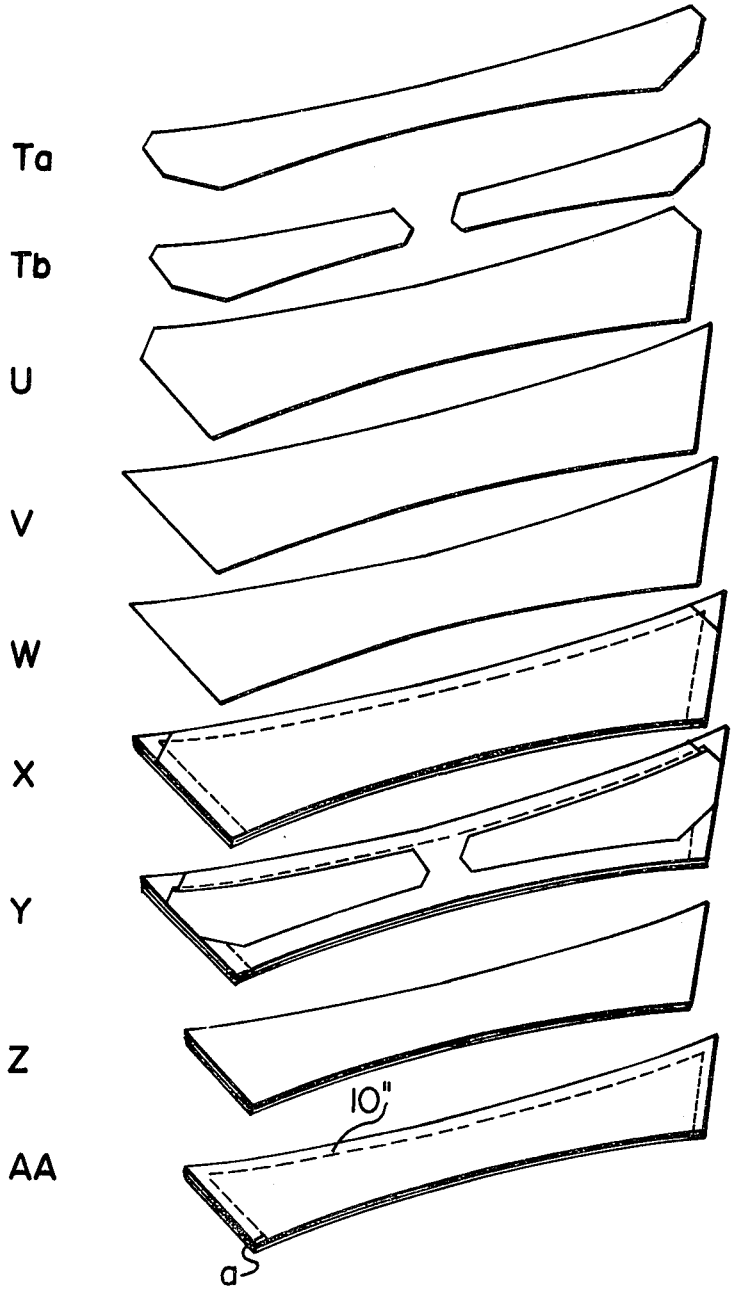
FIG. 4 illustrates a preferred means of putting the invention into practice.

A preferred means of practising the invention is described with reference to FIG. 4. This embodiment does not include alterations of any of the components described above with reference to FIG. 2, but rather relates to a change in the sequence in which the plies are assembled in constructing the cape. The fuse strip or patches utilized in this embodiment are cut from the same type of stiffening material which has had an adhesive coating applied to at least one side for securing the fuse strip or patches to the base lining.

The following parts are used:

1 fuse strip or 2 fuse patches: FIGS. 4T*a* and 4T*b*

1 base lining: FIG. 4U 2 pieces of shell fabric: FIGS. 4V and 4W

Base lining 4U and the two shell pieces 4V and 4W are lined up on top of each other in a predetermined sequence typically in that order from top to bottom, and stitched long three sides (closing) as illustrated in FIG. 4X.

The fuse strip 4T*a* or two fuse patches 4T*b* are now positioned, adhesive side down, on top of the base lining as shown at 4Y, even with the leading edges, and about two mm below the closing seam along the length of the collar cape. This combination is now subjected to a fusing step to permanently bond the patches (or strip) to the base lining. Greater accuracy in placing the patches and avoidance of the needle penetrating the flexible lining are achieved in this manner. Furthermore, the very stringent requirements for cutting the patches as illustrated in FIG. 3 can be eased.

The cape is now turned inside out to project a smooth one-piece appearance hiding the closing seam on the inside as illustrated in FIG. 4Z. Finally an outside seam referred to as topstitching and illustrated at 10″ in FIG. 4AA is applied, laying flat and securing the closing margin on the inside in the same manner as has previously been described in conjunction with FIG. 2.

What I claim as my invention is:

1. A stayless shirt collar cape having a base edge for attachment to a collar band, a finished free edge substantially parallel with said base edge, and two relatively short finished leading edges extending outwardly from the base edge to the free edge to form points, said cape comprising exterior shells with an interlining disposed therebetween, stiffening material disposed between the shells and secured to the interlining, the stiffening material being in the form of at least one patch extending from the points along the free edge in a longitudinal direction of the cape and along the leading edges in a transverse direction of the cape to coincide with a substantial area of the cape between the leading edges, the stiffening material being relatively stiff in the transverse direction of the cape and relatively flexible in the longitudinal direction of the cape.

2. The stayless shirt collar cape according to claim 1, wherein the stiffening material comprises warp threads of a heavy polyester monofilament cord disposed in the transverse direction of the cape.

3. The stayless shirt collar cape according to claim 2, wherein the warp threads of the stiffening material are parallel to the leading edges of the cape.

4. The stayless shirt collar cape according to claim 1, 2 or 3, wherein said stiffening material extends to said leading edges so as to be substantially coincident therewith, but is spaced slightly from said free edge.

5. The stayless shirt collar cape according to claim 1, 2 or 3, wherein at least two thicknesses of said stiffening material exist in selected areas of said cape.

6. The stayless shirt collar cape according to claim 1, 2 or 3 wherein there is more than one layer of the stiffening material along the leading edges of the cape.

7. The stayless shirt collar cape according to claim 1, 2 or 3 wherein the stiffening material includes an adhesive coating applied to at least one side thereof for securing the stiffening material to the interlining.

8. The stayless shirt collar cape according to claim 1, 2 or 3, wherein the area of the cape along the leading edge and adjacent the base edge is free of stiffening material.

9. The stayless shirt collar cape according to claim 1, 2 or 3 wherein substantially triangular areas of the cape subtended by the angles formed by the leading edges and the base edges is free of stiffening material to accommodate the knot of a tie.

* * * * *